US005277788A

United States Patent [19]

Nitowski et al.

[11] Patent Number: 5,277,788

[45] Date of Patent: Jan. 11, 1994

[54] TWICE-ANODIZED ALUMINUM ARTICLE HAVING AN ORGANO-PHOSPHORUS MONOLAYER AND PROCESS FOR MAKING THE ARTICLE

[75] Inventors: Gary A. Nitowski, Natrona; Larry F. Wieserman; Karl Wefers, both of Apollo, all of Pa.

[73] Assignee: Aluminum Company of America, Pittsburgh, Pa.

[21] Appl. No.: 888,687

[22] Filed: May 22, 1992

Related U.S. Application Data

[63] Continuation-in-part of Ser. No. 590,759, Oct. 1, 1990, abandoned.

[51] Int. Cl.[5] ..... C25D 11/12

[52] U.S. Cl. ..... 205/175; 205/172; 205/332

[58] Field of Search ..... 205/175, 172, 332

[56] References Cited

U.S. PATENT DOCUMENTS

| | | | |
|---|---|---|---|
| 4,153,461 | 5/1979 | Berghäuser et al. | 96/75 |
| 4,448,647 | 5/1984 | Gillich et al. | 205/332 |
| 4,554,057 | 11/1985 | Mohr | 205/175 |
| 5,032,237 | 7/1991 | Wieserman et al. | 204/38.3 |

*Primary Examiner*—John Niebling
*Assistant Examiner*—Kishor Mayekar
*Attorney, Agent, or Firm*—Alfred D. Lobo; Glenn E. Klepac

[57] ABSTRACT

A twice-anodized aluminum substrate is anodized sequentially in first and second aqueous electrolytes. In the first, the substrate is conventionally anodized to produce (i) a porous anodic oxide layer having open pores and a passivation layer thereunder. The substrate, now singly-coated, is then anodized in the second electrolyte of an aqueous solution of an organophosphorus compound which generates a residue which is chemisorbed and covalently bonded to the substrate to form (ii) a monomolecular essentially continuous monolayer on the outer surface of (i), and at the same time, the second anodizing step produces (iii) a barrier layer of non-porous aluminum oxide under (i). The thickness of this barrier layer can be increased as a function of the voltage used while maintaining the thickness of (i) substantially constant, and (ii) protects (i) from dissolution. Depending upon the choice of the organophosphorus compound, a hydrophobic, or chemically resistant surface may be produced; or, a surface which provides a leaving group to be reacted with an appropriate organic coating to be applied after the triplex layer is formed.

13 Claims, 2 Drawing Sheets

TWICE-ANODIZED ALUMINUM ARTICLE HAVING AN ORGANO-PHOSPHORUS MONOLAYER AND PROCESS FOR MAKING THE ARTICLE

CROSS-REFERENCE TO RELATED APPLICATION

This application is a continuation-in-part application of Ser. No. 07/590,759 filed Oct. 1, 1990 abandoned.

BACKGROUND OF THE INVENTION

This application is a continuation-in-part application Ser. No. 07/590,759 filed Oct. 1, 1990 abandoned. This invention relates to a process for providing an aluminum article of arbitrary shape with a protective coating consisting of first, second and third coatings, referred to herein as "layers", each distinguishable from another, all of which are electrolytically produced. The first layer produced is a conventional porous anodic oxide layer, with open pores visible at as low as 5000× magnification, such as has been provided in the prior art by making aluminum the anode in an aqueous strong inorganic acid electrolyte, with a metal or carbon cathode, and sufficient electric current is passed through the cell, so that the aluminum surface is converted to an aluminum oxide layer. Such a porous anodic oxide layer, conventionally produced in an aqueous phosphoric acid, oxalic acid, phosphorous acid, chromic acid, or sulfuric acid electrolyte, is referred to herein as a "conventional anodic oxide layer" or "conventional layer".

The conventional layer is typically produced after electropolishing, or, by etching an aluminum article of arbitrary shape, typically a sheet, in the absence of electric current, then anodizing it in an appropriate electrolyte so that the anodic oxide is integrally formed with the aluminum substrate. Such a conventional layer, which may be as much as 15 mils (381 μm) thick or more, having pores open at their external surface and about as deep, with walls approximately as high as 15 mils, also has a very thin non-porous passivation layer which forms the bottoms of the pores. The passivation layer is sometimes less correctly referred to as a "barrier layer".

The thickness of this passivation layer is a function of anodizing conditions such as the voltage used, and the composition, concentration and temperature of the electrolyte; the higher the concentration, the greater the solubility of the substrate in the electrolyte and therefore the less the thickness of the passivation layer. The rate at which the passivation layer reaches its thickness is typically less than about 13 Å/V (Angstroms per volt), so that for a voltage of 40 V the passivation layer is less than about 520 Å thick. The thickness of this layer remains less than about 13 Å/V when either the anodizing conditions or the strong acid used, or both, are changed (see "Anodic Oxide Films on Aluminum" by Diggle, J. W. et al). In general, irrespective of the strong acid used and the conditions of the first anodizing step, the passivation layer is less than 0.5 μm (micrometers) thick, typically less than 1000 Å.

When the conventional layer is formed with phosphoric acid, this very thin non-porous passivation layer underlying the porous oxide layer has essentially no elemental phosphorus (P) in it, or a very low ratio of P/Al, and has excellent adherence to the substrate. Without the protection of the walls of the porous anodic oxide above it, which walls have a relatively high ratio of P/Al, and provide excellent abrasion resistance depending upon their height and thickness, this non-porous passivation layer, on its own, has limited abrasion resistance because it is so thin, and even more limited chemical resistance. By "non-porous" is meant that there are no pores visible at a magnification of about 10,000× or less.

An aluminum substrate protected with only the conventional, thin, first porous anodic oxide layer less than about 10 μm thick offers insufficient protection for the purposes at hand, and economics and other considerations dictate that a thicker first oxide layer is impractical or otherwise undesirable. Therefore the problem to be solved was: how does one enhance the overall protection afforded by a conventional anodic oxide layer about 10 μm thick or more, on an aluminum substrate of arbitrary shape, by providing its surface(s) with at least one additional protective layer, chemically bonded to the anodic oxide surface? Preferably, one should be able to provide the additional protective layer(s) after the conventional layer is formed. The purpose of the protective layer(s) was to provide not only mechanical protection, but also excellent protection against damage by water because the layer is highly hydrophobic, and/or provides high adhesion for a protective coating, preferably by means of a chemical bond rather than mere chain entanglement. For example, an aluminum substrate having a specular reflectance in excess of about 80% was to be maintained despite being exposed to moisture. In another example, an aluminum substrate with a conventional layer about 10 μm thick is to be provided with additional protection against abrasion, and also with a paint. Examples of each of the foregoing are provided in the illustrative examples herein.

This invention more specifically relates to a process, referred to as a "double anodizing process" because the aluminum substrate is twice-anodized, and to the product produced thereby. The process comprises sequentially anodizing the aluminum substrate; initially, the substrate is conventionally anodized in a first electrolytic bath containing an inorganic or carboxylic acid, typically in a phosphoric, sulfuric, or oxalic acid electrolyte, to produce a conventional layer; then, in a second electrolytic bath, the substrate with the conventional layer is anodized in a second electrolytic bath containing an organophosphorus compound. The organophosphorus compound is chosen from a monomeric substituted phosphorous acid referred to herein as an 'organophosphonic acid' having at least two carbon atoms in a substituent; or, a substituted monomeric phosphinic acid referred to herein as an 'organophosphinic' acid.

Phosphorous acid is also referred to as "phosphonic acid" especially for naming organic compounds, and phosphinic acid is also referred to as 'hypophosphorous' or phosphonous acid. These substituted acids are together hereafter referred to herein as "subs/phosphonic/phosphinic acid". Each acid has an organic radical having at least two carbon atoms, which radical may, or may not, have a functional reactive group (referred to as a 'leaving group' herein to minimize confusion with a reactive group of an organic coating which may desirably be provided after the substrate is twice-anodized as described herein) for coupling the organophosphorus compound to a reactive organic compound. In addition to a subs/phosphonic/phosphinic acid, a mono- or diester of phosphoric acid results in the formation of a phosphorus-containing ("P-containing") group as a "head" which is chemisorbed onto the conventional layer, and a "tail" which may, or may not, have a 'leaving group' (or 'reactive group') for coupling the chemisorbed ester to a reactive organic compound. In contrast to the esters of phosphoric acid, the effectiveness of the esters of subs/phosphonic/phosphinic acid are quite ineffective for the same purpose.

Reaction of the head occurs because in solution, the OH groups of the P-containing electrolyte are mostly dissociated, leaving the O atoms of the OH groups of subs/phosphonic/phosphinic acid to interact with the OH groups available on the surface of the substrate. This interaction appears to be equally true for the phosphoryl O atoms (O which is connected to the P atom with a double bond). Inelastic Electron Tunneling Spectroscopy (ITES) and Surface Enhanced Raman Spectra (SERS) provide evidence which confirms the presence of three O atoms bonded to three Al atoms for each P atom.

Accordingly, this invention relates to the production of a substrate having two additional protective layers, in addition to the conventional porous anodic oxide layer, each of which two layers is simultaneously produced by a single electrolytic processing step. One of the two layers is essentially an organophosphorus monomolecular essentially continuous monolayer ("OMM"), chemisorbed under anodizing conditions, on the exterior surface of the first conventional layer and chemically bonded to its surface, to form a metal oxide-organophosphorus complex; the other (of the two layers) is a barrier layer of non-porous oxide, containing essentially no P, which is generated and progressively grown (as explained in detail herebelow) under the passivation layer, that is, contiguous to the unoxided metal substrate.

The term "chemically bonded" refers to covalent or ionic bonding in which there is a sharing of at least one electron between Al and O, O and P, and, P and C.

For ready recognition, convenience and ease of reference, the conventional anodic porous oxide layer or 'conventional layer', is referred to by the reference symbol "(i)", the OMM, is referred to as "(ii)", and the barrier layer, is referred to as "(iii)". In combination, (i), (ii) and (iii) are referred to as a "triplex coating". In the triplex coating, the layer (i) is sandwiched between OMM (ii) and barrier oxide layer (iii). Each of the surface-bonded molecules in the OMM are in closely-packed essentially contiguous relationship on the surface, the Al atoms of which are bonded to the O atoms bonded to P atoms, in turn bonded to a C atom of the organo-substituent.

In those instances where the OMM (ii) which results from such packing of molecules on the surface is specifically intended to generate a hydrophobic surface, the effectiveness of the OMM is measured by equilibrium Sessile drop water contact angles. Typically, a vapor degreased "as received" 6061-T6 aluminum substrate has a contact angle of from 40°-50°; with a nitric/HF acid etch it has a contact angle of from 12°-18°; with conventional phosphoric acid or sulfuric acid anodizing the contact angle is in the range from 20°-30°; with a dip in octylphosphonic acid the contact angle is 68°; with a dip in perfluorinated phosphonic/phosphinic acids the contact angle is in the range from 84°-92°; by anodizing in perfluorinated phosphonic/phosphinic acids the contact angle is in the range from 103°-109°. Thus with a choice of OMM, the contact angle with the (i) may at least be doubled, and preferably more than tripled.

The unique feature of the triplex coating is that, once the conditions for the first anodizing step are set, the thickness of the conventional layer (i) and its OMM (ii) are essentially constant, being fixed by the conditions of the conventional first anodization. However, the thickness of the OMM (ii) is essentially insensitive to the conditions of the second anodizing step, this thickness being determined by the length of the subs/phosphonic/phosphinic acid, or phosphoric acid ester molecule. Under the conditions of the second anodization, the thickness of the non-porous oxide (iii) can be arbitrarily increased by stepping up the voltage, without affecting the thickness of either (i) or (ii). The triplex coating therefore provides a "tailored" non-porous barrier oxide layer (iii) in coextensive contact overlying the substrate of oxide-free aluminum.

In the art of producing aluminum base sheet which is to be coated with light-sensitive material so that the presensitized base sheet may be used for lithographic printing plates, Berghauser et al had discovered that if a conventionally anodized aluminum sheet was simply dipped in a solution of polyvinyl phosphonic acid, rinsed with water and dried, the polymer filled the pores of the conventional layer and provided an excellent base upon which a light-sensitive coating could be coated. Details of this non-electrolytic process for coating a conventional layer with polyvinyl phosphonic acid are disclosed in U.S. Pat. No. 4,153,461. Because the polymer layer was produced by mechanically dipping the sheet into the solution of polymer, its adhesion to the sheet was mechanical, that is, mainly due to interstitial chain entanglement of polymer chains in the pores of the conventional layer, and, one would expect to be able to improve such mechanical adhesive bonding.

About ten years later, improvement of such adhesion of the polyvinyl phosphonic acid to the aluminum base sheet, was disclosed by Gillich et al, in U.S. Pat. No. 4,448,647 for a process in which they used a "mixed electrolytic bath", namely, one in which they used a mixture of the polyvinyl phosphonic acid (Berghauser et al had used), and a strong inorganic acid such as phosphoric acid. Starting with an etched aluminum substrate which they anodized in this mixed electrolytic bath, they simultaneously anodized the aluminum and sealed its surface (col 1, lines 10-11) producing an aluminum oxide film which showed no porosity of its surface (col 10, line 35), presumably because its pores were filled with the polymer they knew provided a good base for the light-sensitive materials they used for lithographic plate. Further, because they combined the polyvinyl phosphonic acid with the phosphoric acid, the surface they produced showed a high ratio of P/Al in the metal-oxide organic complex surface film. This ratio of P/Al was 0.6 to 0.9:1, and in some instances as high as 2:1 (col 10 lines 14-16).

In their '647 patent, Gillich et al succeeded in solving the problem they set out to solve, and they did so in a single step anodizing process, using the mixed phosphoric and polyvinyl phosphonic acid bath. They failed to make the invention claimed in this application because they did not use a sequential "double-anodizing" process, and, they used a polymeric electrolyte rather than a monomeric one. By a monomeric electrolyte we refer to one in which there are no repeating units of linked hydrocarbyl groups, though there may be up to 10 oxophosphorus groups, preferably no more than 6. Had Gillich et al used a first anodizing step with only the phosphoric acid, and then, in a second step, used a monomeric organophosphonic electrolyte, they would have found that the pores were not filled. They disclosed using monomeric 2-ethylhexyl phosphonic acid, but only in combination with the strong acid, not in a separate electrolytic bath; as a result they made a surface which showed no porosity.

The OMM (ii) is preferably formed with molecules having a bondable O-P linkage and an unreactive tail bonded to the P atom through a C atom, resulting in a chemically resistant layer, resistant both to strong acids and alkalis, unless the molecules of (ii) have a 'leaving' group. Whether (ii) has an unreactive or reactive tail, (ii) is also referred to as a "functionalized layer". Though the leaving group is typically to be coupled with the reactive group of a preselected coating, the leaving group may react with the hydroxyl groups available on (i). This might occur, for example, when ethylenediphosphonic acid provides an OMM in which essentially both terminal phosphonic acid groups are chemisorbed on the surface of (i) resulting in a profusion of chains of —$CH_2$— groups protecting the surface of (i) with phosphonic acid groups of closely packed monomeric molecules being essentially contiguous.

To be useful as an aqueous organophosphorus electrolyte, the subs/phosphonic/phosphinic acid, or, phosphoric acid ester, is required to be substantially soluble in water. When the organophosphorus compound is used as an electrolyte deliberately to provide the OMM (ii) with a reactive end group, the OMM (ii) may still be substantially resistant to strong acids and alkalis. Accordingly, (ii) may still be referred to as "chemically resistant".

By "substantially soluble" is meant that the subs/phosphonic/phosphinic acid, or phosphoric acid ester, has sufficient solubility to conduct enough current at a voltage typically used, to anodize the aluminum substrate in an aqueous electrolyte. Such solubility is generally at least 1000 ppm (parts per million by weight of solution) in water, preferably in the range from 1 to 50% by weight, and more preferably from 5 to 25%.

A "functionalized layer" produced on any valve metal is disclosed in U.S. Pat. No. 5,032,237. The term "valve metal" is used generically to refer to aluminum, niobium, tantalum, titanium, tungsten, zirconium and vanadium, each of which is able to form an OMM with an aqueous subs/phosphonic/phosphinic electrolyte, or phosphoric acid ester, to a greater or lesser degree. In the '237 process the functionalized layer was formed in a single-step anodizing procedure, the OMM being formed on the planar non-porous oxide surface as the reaction product of a the subs/phosphonic/phosphinic acid and the oxide.

The basic procedure for forming the functionalized layer of the '237 invention is substantially the same as that for forming the OMM in the instant invention, except that the OMM is now formed on the open-pore surface of the conventional layer (i). The presence of the conventional layer results in the formation of the non-porous barrier oxide layer (iii) under conventional layer (i); more specifically, the layer (iii) is formed under the passivation layer of the conventional layer (i). This layer (iii) is a barrier oxide which is analogously formed as, and has the same very low P/Al ratio as that present, in the barrier oxide layer formed in the '237 process. Recognizing that the formation of the triplex coating will depend upon the reactivity of the P-containing head of the subs/phosphonic/phosphinic acid, or, the phosphoric acid ester, in the electrolyte, with the particular valve metal used, the disclosure of the '237 patent is incorporated by reference thereto as if fully set forth herein.

SUMMARY OF THE INVENTION

It has been discovered that a triplex coating can be produced on the surface of an aluminum substrate in a two step anodizing process. The resulting triplex coating consists essentially of a conventional porous anodic oxide layer "(i)" of aluminum oxide intermediate a non-porous barrier layer "(iii)" (also of aluminum oxide) which is an integral portion of the substrate of essentially oxide-free aluminum, and, a monomeric organophosphorus monomolecular (OMM) essentially continuous layer "(ii)" of a subs/phosphonic/phosphinic acid or phosphoric acid ester chemically bonded to the otherwise exposed open-pore surface of the conventional layer (i), which OMM forms a protective monolayer chemisorbed on (i). $P^{31}$ NMR (nuclear magnetic resonance spectra) provides evidence of the chemical bond between the organophosphorus compound and the aluminum substrate. A scanning Auger Microprobe Depth Profile (Auger Electron Spectroscopy) provides proof that the OMM is indeed essentially a monolayer. The pores of layer (i) provide recesses within which the OMM (ii) is anchored to the numerous surfaces provided within the recesses.

It is therefore a general object of this invention to provide a tailored protective coating consisting essentially of a triplex coating on an aluminum substrate, which triplex coating includes an OMM derived from an organophosphorus compound having an O-P linkage bondable to Al through its O atoms, the remaining tail portion of the compound being bonded to the P atom through a C atom, preferably a subs/phosphonic/phosphinic acid, or through an O atom in, phosphoric acid ester, the compound chosen to provide a specific protective function in addition to the protection provided by the conventional layer (i) and the barrier layer (iii); such specific protective function of the OMM may be provided either by the subs/phosphonic/phosphinic compound or phosphoric acid ester itself; or, by the OMM after it has been reactively coupled with an appropriate reactive organic compound through a leaving group on the OMM.

It is a specific object of this invention to increase the protection, specifically loss due to attrition of individual molecules in the functionalized layer of the '237 patent (on an aluminum substrate) by about an order of magnitude or more, that is, by a factor of at least 10, using the same OMM (ii), for this comparison, essentially uniformly distributed over an open-pore surface of layer (i) which is at least 10 times greater than that of a non-porous planar surface. The mechanical protection provided to the aluminum substrate is increased by a factor correlatable with the relative thicknesses of the combined layers (i) and (iii), compared to that of the non-porous oxide formed in the '237 patent.

It is a specific object of this invention to provide a weather-resistant hydrophobic aluminum substrate such as the wing of an aircraft, with a water repellent surface of chemisorbed perfluorinated phosphonic and phosphinic acids which form (ii), so that the wing will have a minimum proclivity to ice-up under normally "icing" conditions; or a body panel of an automobile, and neither the wing nor the panel needs to be painted after it is anodized to form (ii).

It is another specific object of this invention to provide an aluminum substrate such as a panel for the body of an automobile, or the hull of a boat, with an OMM derived from an organophosphorus compound with a leaving group chosen to react with a reactive group of an organic coating, for example vinyl phosphonic acid to react with an acrylic paint, or aminopropyl phosphonic acid to react with an epoxy paint, at a later time when the OMM of the substrate is coated; the organophosphorus compound is a substantially water-soluble compound chemically bondable to the oxide layer (i), and preferably a subs/phosphonic/phosphinic acid or phosphoric acid ester.

It is still another specific object of this invention to provide an aluminum substrate with a triplex coating, in which the first coating is a conventional phosphoric acid anodized porous oxide layer about 10 μm thick having a high P/Al ratio in the range from 0.1 to 0.5, typically from 0.1 to 0.3, forming a singly-coated substrate, and thereafter, simultaneously providing second and third coatings, the second coating consisting of an OMM of a perfluorinated phosphonic/phosphinic acid covalently bonded to the first coating, and the third coating consisting of a barrier oxide under the first coating, the barrier oxide having a low P/Al ratio in the range from 0.0001 to 0.06, typically from 0.001 to 0.01.

It is another general object of this invention to provide a process for twice-anodizing an aluminum substrate to form the triplex coating on its surface.

It is a specific object of this invention to provide a method for producing a triplex coating on an aluminum substrate comprising, sequentially anodizing the substrate in first and second anodizing procedures, the first procedure comprising anodizing the substrate in a first strong inorganic acid aqueous electrolyte to produce (i) a porous anodic oxide layer having open pores and a passivation layer at less than 13 Å/V, forming the bottoms thereof, on a substrate which is thus singly-coated, and thereafter, in a second anodizing procedure, comprising, anodizing the singly-coated substrate in a second aqueous organophosphorus electrolyte containing a sufficient concentration of organophosphorus compound, at least enough to cover the surfaces of (i), preferably a large excess, to simultaneously generate OMM (ii) on immersed surfaces of (i), and a barrier layer (iii) of non-porous aluminum oxide under (i), the thickness of (iii) growing at the rate of about 14 Å/V; the first procedure further comprising, providing the substrate as an anode in the inorganic or carboxylic acid aqueous electrolyte selected from the group consisting of phosphoric acid, phosphorous acid, oxalic acid, and sulfuric acid, so as to anodize the substrate to produce (i); and, the second anodizing procedure further comprising, anodizing the singly-coated substrate at a voltage equal to, or greater than that used to form (i), in the second aqueous organophosphorus electrolyte comprising a water-soluble subs/phosphonic/phosphinic acid, or, phosphoric acid ester, to generate (iii) in a thickness less than about 14 Å/V, under (i) and integrally with unoxided aluminum substrate.

It is a specific object of this invention, in the particular case of a phosphoric acid anodized conventional layer, to provide a process for forming a triplex coating in which (i) has a relatively high P/Al ratio in the range from 0.1 to 0.3, and in the second anodizing procedure, generating (iii) at least as thick as the passivation layer initially obtained during the formation of (i); the passivation and barrier layers having a very low P/Al ratio in the range from 0.001 to 0.01 (essentially no P).

It is another specific object of this invention to provide a process for forming a triplex coating in which the conventional layer (i) including its passivation layer, is generated at from about 1 V to about 100 V, preferably from about 10 V to about 50 V to form a passivation layer in a thickness produced at less than 13 Å/V; and layers (ii) and (iii) are generated at from about IV to about 400 V, preferably from 10 V to about 60 V, in a thickness of (iii) produced at about 14 Å/V.

BRIEF DESCRIPTION OF THE DRAWINGS

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

In the best mode of this invention, the triplex coating is formed on an aluminum substrate. As stated hereinabove, the OMM (ii) is an essentially organophosphorus monomolecular monolayer formed on the exterior open-pore surface of the conventional layer (i), and covalently bonded to the surface of (i), to form an aluminum oxide-organophosphorus complex only on the surfaces of the pores. The protective monolayer is an aluminum oxide-organophosphorus complex formed by the reaction product of an organophosphorus compound in an aqueous electrolyte and aluminum oxide. The organophosphorus compound is most preferably selected from the group consisting of a subs/phosphonic/phosphinic acid and an ester of phosphoric acid.

The term "aluminum substrate" is used herein to refer not only to essentially pure aluminum having a purity in excess of 99%, but also to known alloys of aluminum which have an aluminum content in excess of about 70%, and metals or non-metals clad with aluminum. Metals alloyed with aluminum typically include not only one or more deliberately added alloying elements, but also impurities such that the alloy contains, for example, a minor amount by weight of silicon, iron, copper, manganese, magnesium, molybdenum, chromium, nickel, zinc, gallium, vanadium, titanium, boron, lithium or zirconium.

Preferred alloys of aluminum are those from the AA 1XXX, AA 2XXX, AA 3XXX, AA 5XXX, AA 6XXX and AA 7XXX series, particularly 1045, 1100, 2090, 2024, 3003, 5042, 5182, 5657, 5252, 6061, 6463, 7075 and 7576, the high strength alloys being of special interest.

The term "aluminum oxide" is used herein not only to include natural aluminum oxide which is typically present on "as received" aluminum sheet, but also to refer to the essentially aluminum oxide walls of the porous oxide, and the non-porous passivation and barrier oxide layers. As one skilled in the art will know, the aluminum oxide on an "as received" aluminum substrate is generally etched before the substrate is used in a conventional anodizing procedure.

Figure 1:
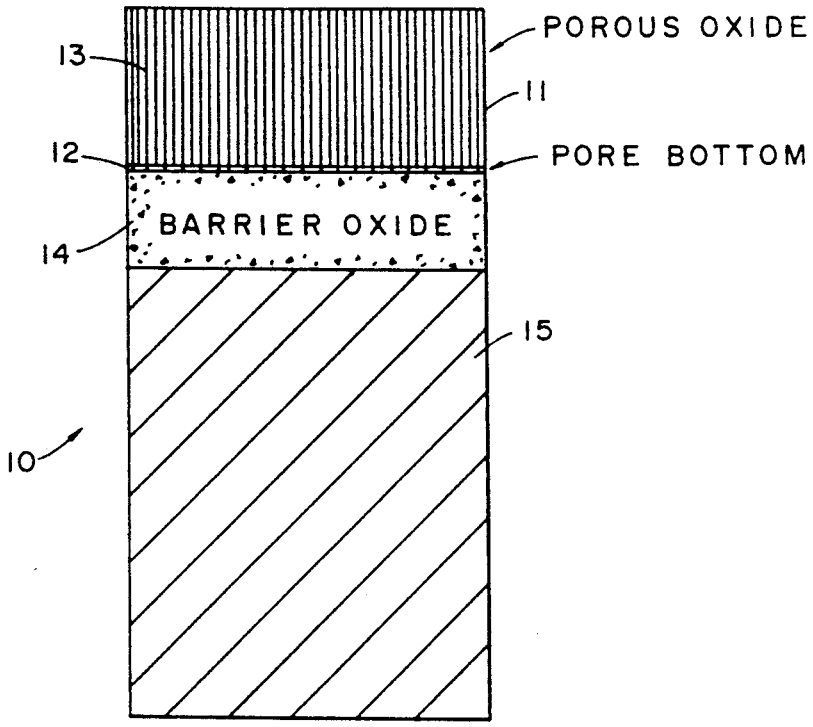
FIG. 1 is a schematic cross-sectional illustration, greatly enlarged, of a portion of a section near the surface of a sample of double-anodized aluminum substrate representing a barrier oxide layer sandwiched between a conventional porous oxide layer and the aluminum substrate.

As illustrated in FIG. 1, the morphology of the portion of sample, indicated generally by reference numeral 10, shows a porous oxide structure 11, supported on a thin non-porous passivation layer 12 which forms the bottoms of the pores 13 in the first anodizing step. The layer 12 is, in turn supported by a barrier oxide layer 14 formed on the aluminum substrate 15 in the second anodizing step.

Figure 2:
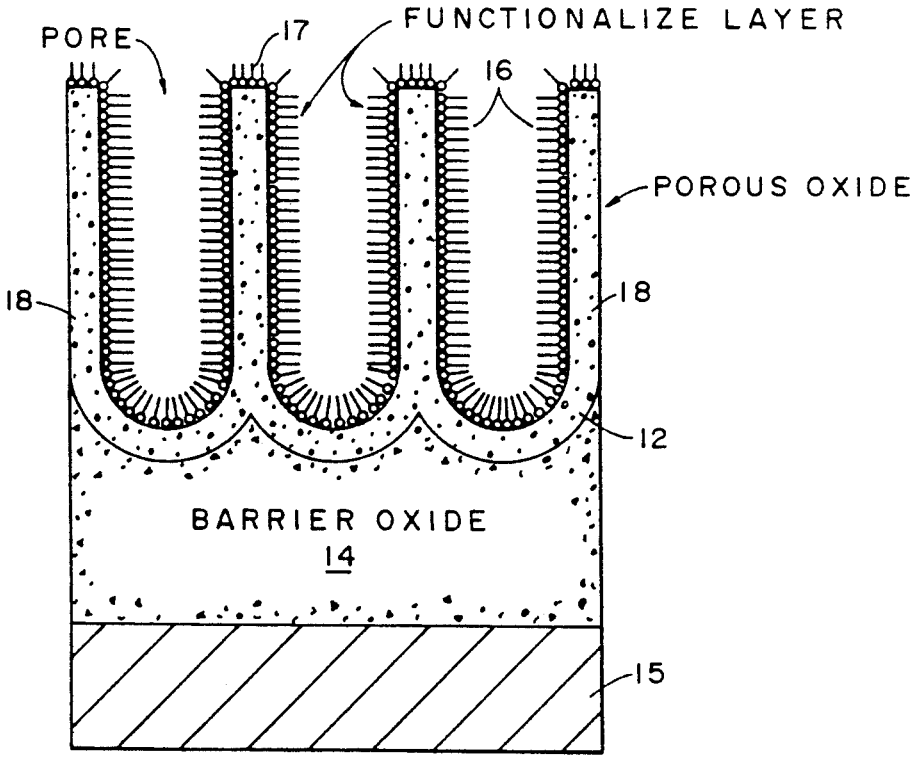
FIG. 2 is a schematic cross-sectional illustration, even more greatly enlarged than FIG. 1, of the portion of the sample, showing the OMM (ii) and barrier oxide (iii) with the conventional layer (i) sandwiched therebetween.
Figure 4A:
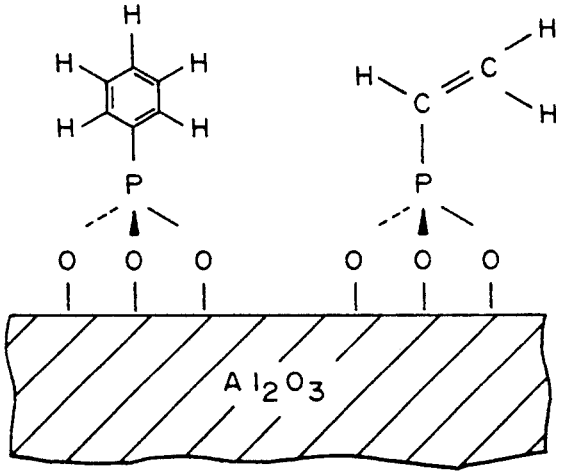
FIG. 4A is a schematic illustration of the chemical bonding of the phosphonic acid head of an organophosphorus compound to Al atoms on the surface of the conventional layer (i), showing how the tail protrudes away from the surface in most instances when the leaving group is not bonded to the surface.
Figure 4B:
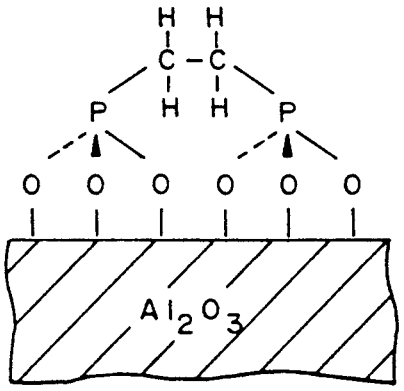
FIG. 4B is a schematic illustration of the chemical bonding of both the phosphonic head and tail (when the leaving group is also a phosphonic acid group), of a diphosphonic acid, to Al atoms on the surface of the conventional layer (i), showing how the hydrocarbyl body of the molecule is held away from the surface.

Details of the structure illustrated in FIG. 1 are shown in FIG. 2 where the OMM 16 is shown as molecules 17 having O and P atoms in a head (shown as a circle) and the carbon-containing chain in a tail (shown as a line) deposited on the surfaces of the walls 18 which define pores 13. The molecules 17 are packed in substantially contiguous relationship, and exhibit a preferred orientation in which the oxygen atoms of the organophosphorus compound are covalently bonded to the aluminum oxide surface while the organic substituent R is distally disposed relative to the porous aluminum oxide surface. The result is that each of the three O atoms in each "head" is bonded to an Al atom of (i); each O atom in turn is connected to a P atom which in turn is connected to a C atom of the tail (organic substituent). The tail thus protrudes away from the surface of (i) forming a tetrahedral-like structure having the P atom at its vertex and the O atoms at each corner as illustrated in FIG. 4A.

The passivation layer 12 and the barrier oxide layer 14 are each non-porous layers distinguishable by the low ratio of P/Al in each, and the rate of formation of the oxide thickness as a function of voltage used. As the anodizing process proceeds, the thickness of the non-porous layer increases until the layer becomes electrically insulating at the voltage being used, i.e., when current flow approaches zero, at 50 volts, for example, the thickness reached will be about 700 Å. However, if the voltage is raised to 75 volts, current flows until the oxide layer gets thicker, and again, the current flow approaches zero when the thickness approaches 1050 Å.

The following are illustrative examples in which typical process conditions are used for double anodizing an aluminum substrate:

EXAMPLE 1

Anodized in a first bath of phosphoric acid, then anodized in a second bath of phenylphosphonic acid $PhP(O)(OH)_2$:

A 5 cm×5 cm coupon of as received 3003-O aluminum alloy, 5 mm thick, is a typical substrate which is first degreased by wiping it with cheesecloth soaked in toluene. The cleaned coupon is then etched in aqueous 5% NaOH at 50° C. for 30 sec. As an alternative, the etching may be done in a strong inorganic acid bath. The etched coupon is then rinsed in flowing deionized water prior to being anodized.

The foregoing solvent-cleaning and etching steps are not essential pre-requirements for twice anodizing the coupon, but for best results it is preferred to start with a thoroughly cleaned and adequately etched coupon. Upon being etched and rinsed, the coupon may be directly placed in a first anodizing bath; or, the coupon may be dried and stored for later use.

In the first bath held at 23° C., the coupon is conventionally anodized in 10% $H_3PO_4$ at 10 V for 20 min, to generate a conventional layer about 0.5 μm thick, the passivation layer being less than about 130 Å thick. The porous oxide formed is found to have pores of substantially the same diameter in the range from about 200–300 Å as measured by Transmission Electron Microscopy (TEM) @172,000× magnification. An analogous oxide layer forming a singly-coated coupon would be produced with sulfuric, chromic, or oxalic acid, except of course, the oxide layer would not contain P but the ions of S or C (no Cr ions are found in the layer). The anodized, singly-coated coupon is removed from the first bath, and rinsed in flowing deionized water. As before, the coupon may be dried if it is to be stored, but if not, it is directly placed in a second electrolytic bath containing 0.1M phenylphosphonic acid and anodized @30 V for 2 min @23° C. When the flow of current is negligibly small, the coupon is removed, rinsed with flowing deionized water and dried by blowing air over it. The size of the pores, determined by TEM at 172000×, remains essentially the same, 200–300Å, after the second anodizing step. The thickness of the barrier oxide layer under the passivation layer was not measured.

EXAMPLE 2

Anodized in a first bath of phosphoric acid, then anodized in a second bath of phenylphosphinic acid $PhP(O)(OH)(H)$:

In a manner analogous to that described in Example 1 hereinabove, a singly-coated coupon is provided with a conventional layer in a 10% $H_3PO_4$ solution at 10 V for 20 min at 23° C., and then anodized a second time, in a 0.1M phenylphosphinic acid bath at 30 V for 2 min, to produce pores, all having substantially the same diameter in the range from about 300–400 Å.

EXAMPLE 3

Anodized in a first bath of phosphoric acid, then dipped without anodizing in a second bath of Fluowet$PP^R$:

In a manner analogous to that described in Example 1 hereinabove, a singly-coated coupon is provided with a conventional layer in a 10% $H_3PO_4$ solution at 10 V for 20 min at 23° C., and then dipped for 2 minutes without anodizing, in a bath of a mixture of perfluorinated phosphonic and phosphinic acids commercially available as FluowetPP from Hoechst Celanese Corp. The mixture of acids is present in a concentration of 4.3 g/100 ml (4.3% solution). The structures of the FluowetPP acids are perfluorinated aliphatic phosphonic acids, and perfluorinated aliphatic phosphinic acids, generally represented as follows:

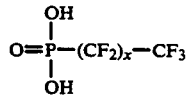

perfluorinated aliphatic phosphonic acid

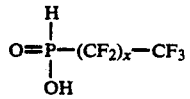

perfluorinated aliphatic phosphinic acid wherein x is an integer in the range from 2 to 10.

EXAMPLE 4

Anodized in a first bath of phosphoric acid, then anodized in a second bath of FluowetPP$^R$ at 30 V:

In a manner analogous to that described in Example 1 hereinabove, a singly-coated coupon is provided with a conventional layer in a 10% $H_3PO_4$ solution at 10 V for 20 min at 23° C., and then anodized a second time, at 30 V for 2 min, in a bath containing a 4.3% solution of the mixture of perfluorinated phosphonic and phosphinic acids. Pores, all having substantially the same diameter in the range from about 200–300Å, are produced on the surface.

EXAMPLE 5

Anodized in a first bath of phosphoric acid, then anodized in a second bath of FluowetPP$^R$ at 90 V:

In a manner analogous to that described in Example 1 hereinabove, a singly-coated coupon is produced in the first bath (10% $H_3PO_4$ solution) at 10 V for 20 min at 23° C., and then anodized a second time, at 90 V for 2 min, in a bath of a 4.3% solution of FluowetPP, to produce pores all having substantially the same diameter in the range from about 200–300 Å.

Figure 3:
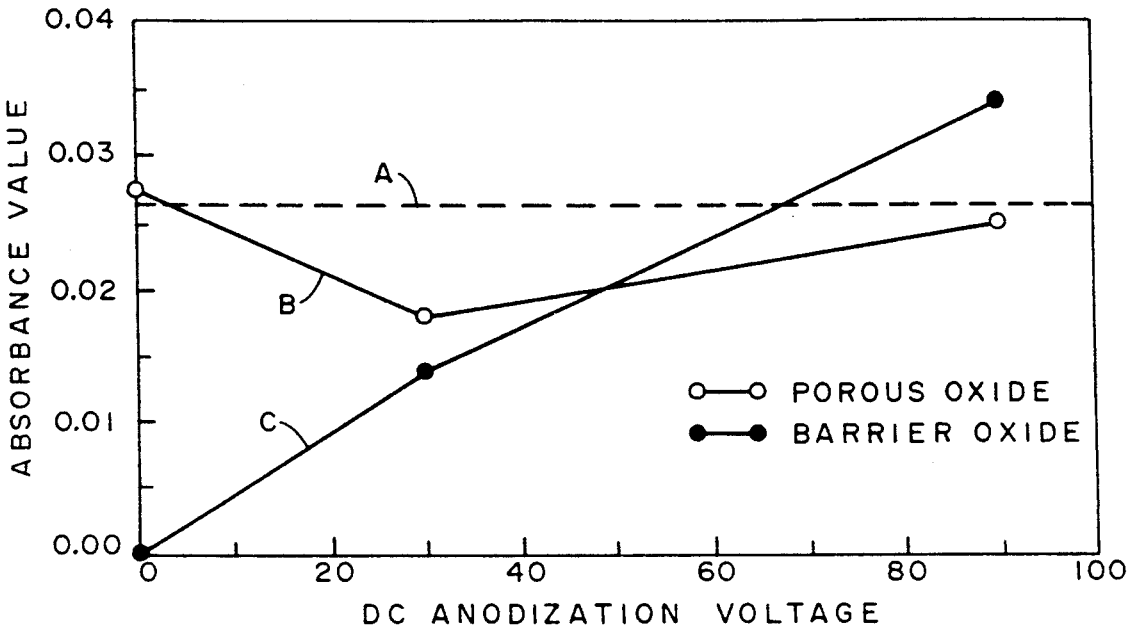
FIG. 3 is a graph in which the FT-IR absorbance values are provided for the surface of samples (coupons) which were twice-anodized at different DC anodization voltages; and, one sample anodized only once, and dipped.

Comparison of FT-IR analysis of surfaces of coupons from Examples 4 and 5 (twice-anodized) with a sample of Example 3 (anodized only conventionally, then dipped):

The results of an analysis of the surface of the coupons by specular reflectance FT-IR shows that oxide signal due to phosphoric acid anodic oxide does not change as a function of the voltage used in the second bath (of FluowetPP) as evidenced in the graph in FIG. 3.

Referring to FIG. 3 there is shown a plot of Absorbance Value against DC Anodization Voltage for three samples, each of which was first conventionally anodized in 10% by wt $H_3PO_4$ for 20 min at 10 V and at 23° C. The dashed line, indicated by reference letter 'A' shows the absorbance value for each and every one of these conventionally anodized samples. Thereafter, the first sample was simply dipped in 4.3% FluowetPP (zero DC anodization voltage); a second sample was anodized in a 0.1M phenylphosphonic acid bath at 30 V and 23° C. until flow of current ceased; a third sample was anodized at 90 V and 23° C. until flow of current ceased.

The plot for absorbance values of the porous oxide (points marked by circles) indicated by reference letter B, shows that the thickness (height of the walls of the pores) of the porous anodic oxide layer (i) remains essentially the same. The plot for the absorbance values for barrier oxide (iii) (points marked by solid circles) indicated by reference letter C, shows that the thickness of (iii) is directly proportional to DC voltage. This is confirmed by a statistical analysis of the three points which provides a strong indication that there is a substantially linear correlation of thickness of layer (iii) with voltage. Similarly, there is a strong indication that there is no substantial change in the thickness of (i). A TEM photomicrograph shows that the morphology (walls and pores defined by them) of the triplex layer is essentially the same as that of (i).

A scanning Auger Microprobe Depth Profile using argon ion beam sputtering shows P, C, Al and O are in the outermost and successively lower layers, and these signals continue until the barrier oxide layer is reached. This is realized when the signals show only Al and O.

Comparison of wetting and adhesion of a water droplet on samples of Examples 4 and 5 (twice-anodized), with a sample of singly-coated coupon in a manner analogous to that described in Example 1 (once-anodized only conventionally):

The degree to which the surface of each sample is wetted with water is tested by a simple test. Droplets of water are dropped onto each sample in a freezer. It is evident to the naked eye (from the contact angle) that the droplets on the conventional phosphoric acid anodic oxide (10 V, 20 min, 10% $H_3PO_4$, 23° C.) wet the surface, while those on coupons from Examples 4 and 5 do not (the droplets are globules). Upon allowing the water on the samples to freeze it is evident to the naked eye that the droplets on coupons from Examples 4 and 5 remain essentially spherical, but those on the once-anodized coupon from Example 1 are flattened. The adhesion of the droplets is tested by simply pushing on each with the eraser on the end of a pencil. The frozen globules of ice are easily rolled along the surface with a gentle push of the eraser, indicating essentially no adhesion of the globules to the surface. The frozen flattened droplets of ice on the once-anodized surface of the sample from Example 1 are so strongly adhered to the surface that, with increasing force, the ice fractures, but not at the frozen interface. This indicates cohesive failure in the ice, not adhesive failure at the interface.

EXAMPLES 6–9

The following series of examples is run to determine the effect of the second anodizing step on the bonding of Fluowet molecules to the surface of coupons of essentially pure aluminum (99.99% Al).

All coupons are cleaned by wiping with toluene, then etched in 5% NaOH solution at 50° C. for 1 min, and rinsed in deionized water (DI water). The coupons are then anodized (once-anodized) in 15% $H_2SO_4$ for 30 min at 23° C. and 12 ASF to produce a porous anodic oxide greater than 10 μm thick. The once-anodized coupons are then rinsed in DI water.

Example 6: A once-anodized coupon is dipped in a solution of Fluowet (4.3%) for 2 min at 23° C., rinsed in DI water and dried at 50° C.

Example 7: A once-anodized coupon is anodized at 30 V in a solution of Fluowet (4.3%) for 2 min at 23° C., rinsed in DI water and dried at 50° C.

Example 8: A once-anodized coupon is anodized at 60 V in a solution of Fluowet (4.3%) for 2 min at 23° C., rinsed in DI water and dried at 50° C.

Example 9: A once-anodized coupon is anodized at 90 V in a solution of Fluowet (4.3%) for 2 min at 23° C., rinsed in DI water and dried at 50° C.

FT-IR analysis of the surface of the coupons showed increasing concentrations of Fluowet as a function of anodizing voltage used on the test coupons.

Each of the coupons from examples 6–9 is placed in a 500 ml beaker of DI water and removed after 72 hr for analysis of the surface.

Analysis of the coupon from example 6 showed increased surface hydroxide, indicating that coverage of the surface by Fluowet is incomplete. The surface hydroxide provides evidence that no continuous monomolecular layer is present.

Analysis of the soaked coupons from examples 7–9 showed that there is substantially no change in the surface concentration from that measured prior to soaking.

The substantially water-soluble substituted phosphonic acid used herein is represented by the general formula:

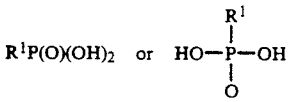

(I)

wherein $R^1$ is a substituent having at least 3 carbon atoms except when the substituent is vinyl when the substituent has only 2 C atoms; provided further, that (I) is substantially water-soluble.

Preferred are vinylphosphonic acid, phenylphosphonic acid $PhP(O)(OH)_2$ and ethylphenylphosphonic acid $EtPhP(O)(OH)_2$. Other preferred substituents are those which provide a leaving group, at or near the end of the substituent, the leaving group being distally disposed relative to the P atom. Such a leaving group is a vinyl group (double bond), as in vinylphosphonic acid. Other leaving groups include —COONa, —COOH, $—NH_2$, —SH, $—CH{=}CH_2$, —OH and —CN. The choice of leaving group is dictated in large part by the desired subsequent reaction, the purpose of which would be to covalently bond the reactive group of a preselected coating compound to the tail of a molecule in the OMM which in turn is bonded through the P-containing acid group to the aluminum oxide surface.

More specifically, in the general formula:

$R^1P(O)(OH)_2$ $R^1$ represents $C_3$–$C_8$ alkyl or haloalkyl, $C_2$–$C_{28}$ alkenyl, $C_3$–$C_8$ alkoxyalkyl, $C_3$–$C_{20}$ mono- or polycarboxylic acid, $C_3$–$C_{20}$ mono- or polyhydric alcohol, $C_3$–$C_6$ alkylamino, $C_3$–$C_{20}$ mono- or polysulfhydryl, $C_3$–$C_6$ cycloalkyl, phenyl, $C_7$–$C_{14}$ alkaryl, 5-membered or 6-membered heterocyclic rings wherein the ring is connected through a C atom, and, $C_7$–$C_{14}$ aralkyl.

$C_3$–$C_8$ alkyl or haloalkyl substituents may be branched or unbranched alkyl, for example n-propyl, isopropyl, n-butyl, sec.-butyl, tert.-butyl, n-pentyl and n-hexyl, $C_3$–$C_6$ alkyl being preferred.

$C_2$–$C_8$ alkenyl substituents may be vinyl, methallyl, 2-butenyl and 2-hexenyl, vinyl being preferred.

$C_3$–$C_8$ alkoxyalkyl substituents may be ethoxymethyl, 2-methoxyethyl, 2-ethoxyethyl, 2-n-butoxyethyl or 2-n-butoxypropyl.

$C_3$–$C_6$ cycloalkyl substituents may be cyclopropyl, cyclopentyl, and cyclohexyl.

$C_7$–$C_{14}$ alkaryl substituents may be phenyl substituted by $C_1$–$C_4$ alkyl, such as p-tolyl, 2,4-diemthylphenyl, 2,6-dimethylphenyl-2,4-diethylphenyl, 4-tert.-butylphenyl and 2,4-di-tert.-butyl-phenyl.

5-membered or 6-membered heterocyclic rings are pyrrolidine, oxazolidine, piperidine, or morpholine.

$C_7$–$C_{14}$ aralkyl substituents are for example, benzyl, p-methylbenzyl, p-tert.-butylbenzyl and 1-phenylethyl.

The substituted phosphinic acid used herein is represented by the formula:

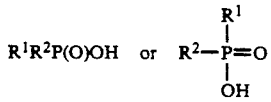

(II)

wherein, $R^1$ has the same connotation as that given hereabove, and $R^2$ has the same connotation as $R^1$ or is H.

Synthesizable compounds include those having the following organic functional groups near the end of a molecule chemisorbed on the conventional layer:

$—(CH_2)_{x'}—CH{=}CH_2$
wherein x' is an integer from 0 to 6

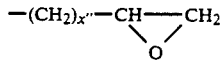

wherein x'' is an integer from 2 to 6

$—(CH_2)_{x''}—COOH$ $—(CH_2)_{x''}—CF_3$ $—(CH_2)_{x''}—CH_2OH$

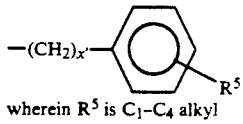

wherein $R^5$ is $C_1$–$C_4$ alkyl $—(CH_2)_{y'}—NH_2$
wherein y' is an integer from 3 to 6

$—(CH_2)_{x''}—NH—COOH$ $—(CH_2)_{y'}—SH$ $—(CH)_{x''}—N{=}C{=}O$ $—(CH)_{x''}—CH_3$

In addition to the aforementioned perfluorinated compounds, specific others which provide hydrophobicity are: butylphosphonic acid; chlorobutylphosphonic acid; cyclohexylphosphonic acid; cyanophenylphosphonic acid; octylphosphonic acid; octadecylphosphonic acid; pentylphosphonic acid; phenylethylphosphonic acid; 4-biphenylphosphonic acid; phenyldiphosphonic acid; pentafluorophenylphosphonic acid; pyridinephosphonic acid; pyrimidinephosphonic acid; pyrrolephosphonic acid; quinolinephosphonic acid; 1,10-decanediphosphonic acid; etc.

Specific compounds with desirable leaving groups are: aminobenzylidenebisphosphonic acid; aminobutylphosphonic acid; aminodecylphosphonic acid; aminoethylphosphonic acid; aminomethylenebisphosphonic acid; aminophenylphosphonic acid; 3-amino-3-phosphonobutanoic acid; benzylphosphonic acid; 4-bromobutylphosphonic acid; 2-bromoethylphosphonic acid; bromophenylphosphonic acid; 1,3-butadiene-1,4-diphosphonic acid; 1,2- and 1,3-butadienylphosphonic acid; 2-butene-1,4-diphosphonic acid; butenylphosphonic acid; cyclopentenephosphonic acid; cyclohexenephosphonic acid; phosphonoacetic acid; phosphonobenzoic acid; phosphonobutanedioic acid; phosphonobutanoic acid; 1,2-propanediylphosphonic acid; propenylphosphonic acid; propynylphosphonic acid; aminobutylphosphinic acid; aminodecylphosphinic acid; aminoethylphosphinic acid; bis(phenylethynyl)-phosphinic acid; and diethynylphosphinic acid.

Though only the subs/phosphonic/phosphinic acids are named above it will be appreciated that a salt of the named acid may be used if, upon being dissolved in water, the salt provides an electrolyte which is functionally equivalent to the acid. Such salts are typically the ammonium salts, alkaline earth metal salts particularly those of magnesium and calcium, and alkali metal salts particularly those of sodium and potassium.

Effective esters are those of phosphoric acid in which one or two, but no more than two OH groups are replaced with an organic radical; and, salts of such esters. Such esters are represented by the formulae $$R^3[O—P(O)(OH)_2] \text{ and } R^3R^4[O—P(O)OH] \quad \text{(III)}$$

wherein $R^3$ and $R^4$ independently represent $C_3$–$C_{20}$ alkyl, $C_5$–$C_7$ cycloalkyl, $C_1$–$C_8$ alkoxy, $C_3$–$C_{20}$ cycloalkoxy and phenoxy or naphthoxy substituents, each substituent may itself be substituted; and, $R^4$ may be the same as $R^3$ or H except both cannot be cycloalkyl. Salts include the ammonium salts, alkaline earth metal and alkali metal salts, as stated.

Most preferred ester is phytic ester which provides excellent protection against moisture, and maintenance of high specular reflectance, preferably at least 70% after exposure to water at room temperature (20° C.) for six months, for an Al substrate having a triplex coating with an initial specular reflectance of 90%.

Specific esters of phosphoric acid are: diisobutyl phosphate; dicresyl phosphate; most preferably the phytic ester having the structure

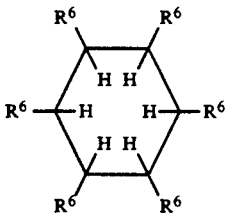

wherein $R^6$ represents $-O-\overset{\overset{\displaystyle OH}{|}}{\underset{\underset{\displaystyle O}{\|}}{P}}-OH$ The subs/phosphonic/phosphinic acids having structures (II) and (III) having the defined substituents are more effective than compounds having two-carbon linkages other than vinyl, or other linkges not containing at least two directly connected carbon atoms. For example, a coupon of 3003-0 aluminum alloy conventionally anodized in 15% $H_2SO_4$ as described above, is then anodized in a 0.1M solution of nitrilotris(methylene)triphosphonic acid having the formula $$N—[(CH_2)P(O)(OH)]_3$$

and structure

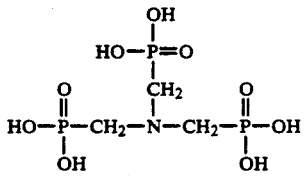

to produce a coupon with a triplex coating. However this coating is substantially less effective than one provided with vinylphosphonic acid or the Fluowet.

In an analogous manner to that described immediately hereinabove, a coupon of 3003-0 aluminum alloy is first anodized in 15% sulfuric acid, then anodized in a 10% solution of 1-hydroxyethylidene-1,1-diphosphonic acid having the formula $(CH_3)(OH)C—[P(O)(OH)_2]_2$ and the structure

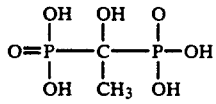

Like the previous coupon, the triplex coating on this coupon does not provide as chemically resistant a surface as phenylphosphonic acid.

The aluminum substrate to be treated may be in the form of foil, sheet, plate, extrusion, tube, rod or bar. The shape of the aluminum surface may be planar, arcuate or in any other shape which will not interfere with formation of the triplex coating thereon.

The conventional layer (i) may be generated conventionally as described hereinabove, but may also be generated in an electrolyte which is a combination of inorganic and organic acids, such as the sulfophthalic/sulfuric acid electrolyte disclosed in U.S. Pat. No. 3,227,639, incorporated by reference thereto as if fully set forth herein. Such an anodization step produces a porous oxide coating (i), which is then anodized in the second step.

The aqueous electrolyte used in the first and second baths may range in concentration from a 0.001M (molar) solution to a saturated one, preferably from about 0.1M to about 2M.

Formation of the conventional layer (i) is most preferably accomplished as described in U.S. Pat. No. 4,025,681 to Donnelly et al (referred to as the Boeing process) the disclosure of which is incorporated by reference thereto as if fully set forth herein. Preferred is an anodization voltage in the range from about 30 to 90 volts depending upon the desired thickness of the layer (i) which will be generated at less than about 13 Å per volt. The anodization is carried out until the desired film weight (or thickness) is reached, the passivation layer having a thickness of about 13 Å/V being been formed. The current density may range from about 0.5–1 amps/dm$^2$ for a pure aluminum (99.99%) substrate to about 1-5 amps/dm$^2$ for a highly alloyed aluminum substrate.

The extent of the protection provided by the OMM is evidenced by the formation of the barrier oxide (iiii) under normally anodizing conditions (strong inorganic acid in the range from pH 0.1-4.5) with the subs/phosphonic/phosphinic acid or phosphate electrolyte, to produce and grow the barrier oxide (iii). Without the OMM, the passivation layer is continuously dissolved and reformed as it advances through the metal.

The density of (iii) ranges from 2.8 to 3.2 gm/cc. The thickness of (ii) ranges from 100-5000 Å, typically from 400-1000 Å, depending upon the voltage used.

The thickness of OMM (ii), that is, the distance over which the molecules protrude away from the surface, depends upon the length of a molecule of the organophosphorus compound used, and is generally less than 5000 Å, in the range above 5 Å but less than 500 Å thick.

The properties of the OMM (ii) may be controlled for specific applications by choosing the appropriate subs/phosphonic/phosphinic acid or phosphoric acid ester. Properties such as wetting, chemical reactivity, polarity, hydrophobicity, hydrophilicity will affect the performance of the twice-anodized substrate for its intended application. For example, OMM (ii) may be used for improved adhesive bonding of polymers with, or without, a leaving group. Adhesives which may be used with an unreactive long chain $C_6$-$C_{20}$ alkyl-substituted OMM (ii) end group include hot-melt adhesives and other polymeric materials having number average molecular weights in the range from 1000 to $10^6$. Such adhesives are mechanically bonded by chain entanglement, as are primers and paints having unreactive end groups. An OMM with a leaving group is especially effective with commercial finishes having an appropriately reactive end group.

Having thus provided a general discussion, described the overall process in detail and illustrated the invention with specific examples of the best mode of carrying out the process, and the best emodiments of aluminum substrates provided with a triplex coating, it will now be evident that the invention has provided an effective solution to a difficult problem. It is therefore to be understood that no undue restrictions are to be imposed by reason of the specific embodiments illustrated and discussed, except as provided by the following claims.

We claim:

1. A method for producing a triplex coating on an aluminum substrate comprising, sequentially anodizing said substrate in first and second anodizing procedures, said first procedure comprising anodizing said substrate in a first aqueous acid electrolyte selected from the group consisting of phosphoric acid, phosphorous acid, oxalic acid, chromic acid, and sulfuric acid to produce (i) a porous anodic oxide layer having open pores and a passivation layer forming bottoms thereof, forming a singly-coated substrate on an outer surface thereof; and thereafter, in a second anodizing procedure comprising, anodizing said singly-coated substrate in a second aqueous organophosphorus-containing electrolyte consisting essentially of a substantially water-soluble organophosphorus compound having a head portion containing an O-P linkage bondable to Al through its O atoms, and a remaining tail portion of said compound having at least two directly linked carbon atoms which are bonded to the P atom of said linkage through a C atom, so as to generate (ii) an organo-phosphorus monomolecular essentially continuous monolayer on said porous anodic oxide layer outer surface, and simultaneously to produce (ii) a barrier layer of non-porous aluminum oxide under said porous anodic oxide layer; said non-porous barrier oxide layer being generated in a thickness of about 14 Å/volt under said porous anodic oxide layer and integrally with unoxidized aluminum, said O-P linkage being chemically bonded to Al atoms in said outer surface, said porous anodic oxide layer having a P/Al ratio of 0.5 or less; and said barrier layer having a P/Al ratio in a range from 0.0001 to 0.06.

2. The method of claim 1 wherein said organophosphorus compound is a monomeric compound selected from the group consisting of a substituted phosphonic acid, a substituted phosphinic acid, and an ester of phosphoric acid, each having a substituent having at least 3 carbon atoms except when the substituent is vinyl when it has only 2 carbon atoms.

3. The method of claim 2 wherein said substituted phosphonic acid is represented by the formula

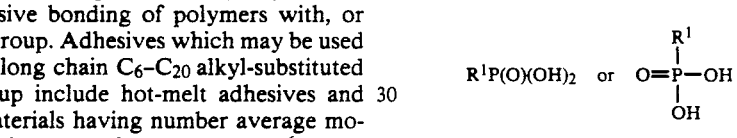

(I)

said substituted phosphinic acid is represented by the

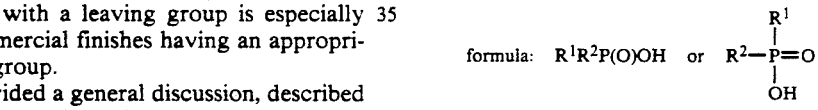

(II)

wherein $R^1$ represents $C_3$-$C_8$ alkyl or haloalkyl, $C_2$-$C_{28}$ alkenyl, $C_3$-$C_8$ alkoxyalkyl, $C_3$-$C_{20}$ mono- or polycarboxylic acid, $C_3$-$C_{20}$ mono- or polyhydric alcohol, $C_3$-$C_6$ alkylamino, $C_3$-$C_{20}$ mono- or polysulfhydryl, $C_3$-$C_6$ cycloalkyl, phenyl, $C_7$-$C_{14}$ alkaryl, 5-membered or 6-membered heterocyclic rings wherein the ring is connected through a C atom, and, $C_7$-$C_{14}$ aralkyl;

$R^2$ has the same connotation as $R^1$, or is H; and, said phosphoric acid ester is represented by the formulae $$R^3[O—P(O)(OH)_2] \text{ and } R^3R^4[O—P(O)OH] \quad \text{(III)}$$

wherein $R^3$ and $R^4$ independently represent $C_3$-$C_{20}$ alkyl, $C_5$-$C_7$ cycloalkyl, $C_1$-$C_8$ alkoxy, $C_3$-$C_{20}$ cycloalkoxy and phenoxy or naphthoxy substituents, each substituent may itself be substituted; and, $R^4$ may be the same as $R^3$ or H except both cannot be cycloalkyl.

4. The method of claim 3 wherein said second electrolyte has a concentration in a range from about 0.001M (molar) solution to a saturated solution of said organophosphorus compound being sufficient at least to cover the surfaces of said porous anodic oxide layer, and to simultaneously generate said (ii) organophosphorus monomolecular essentially continuous monolayer on immersed surfaces of said outer porous anodic layer, and said barrier layer of non-porous aluminum oxide under said porous anodic oxide layer, the thickness of barrier layer growing at a rate of about 14 Å/V.

5. The method of claim 3 wherein said second electrolyte has a concentration in a range from about 0.1M to about 2M and said organophosphorus monomolecular essentially continuous monolayer is essentially uniformly distributed over an open-pore surface of porous anodic oxide layer which has a surface area at least 10 times greater than that of a non-porous planar surface.

6. The method of claim 4 wherein said passivation layer of said singly-coated substrate is generated at from about 10 V to 50 V in a thickness produced at less than 13 Å/V; said outer surface is less than 10 μm thick; and said singly-coated substrate is anodized in said second anodizing procedure at a voltage at least equal to the voltage used in said first anodizing procedure.

7. The method of claim 4 wherein said organophosphorus monomolecular essentially continuous monolayer is in a range from about 100–5000 Å, and said second anodizing procedure increases the thickness of said barrier layer as a function of voltage without significant dissolution of said barrier layer.

8. The method of claim 4 wherein said organophosphorus compound having said bondable O-P-linkage is bonded to Al on said porous anodic oxide layer, and said remaining portion is essentially unreactive with strong organic and inorganic acids and bases, so as to form a chemically resistant surface having a Sessile drop equilibrium water contact angle at least double that of the contact angle on said porous anodic oxide layer.

9. The method of claim 4 wherein said organophosphorus compound having said bondable O-P-linkage is bonded to Al on said outer surface, and said remaining portion has a leaving group chosen to react with an organic coating to be applied over said triplex coating.

10. The method of claim 4 wherein said organophosphorus compound is selected from the group consisting of vinyl phosphonic acid, a perfluorinated phosphonic acid having from 2 to 10 $CF_2$ groups, and a perfluorinated phosphinic acid having from 2 to 10 $CF_2$ groups.

11. The method of claim 1 wherein said monolayer is essentially uniformly distributed over pores having substantially the same diameter in a range from about 200–500 Å in an open pore surface of said porous anodic oxide layer, which surface has an area at least 10 times greater than that of a non-porous planar aluminum oxide surface.

12. The method of claim 11 wherein said monolayer is a residue of a compound selected from the group consisting of phenylphosphonic acid; perfluorinatedphosphinic acid; perfluorinatedphosphinic acid; quinolinephosphonic acid; butylphosphonic acid; chlorobutylphosphonic acid; cyclohexylphosphonic acid; cyanophenylphosphonic acid; octylphosphonic acid; octadecylphosphonic acid; pentylphosphonic acid; phenylethylphosphonic acid; 4-biphenylphosphonic acid; phenyldiphosphonic acid; pentafluorophenylphosphonic acid; pyridinephosphhonic acid; pyrimidinephosphonic acid; pyrrolephosphonic acid; and, 1,10-decanediphosphonic acid, and said substrate is hydrophobic.

13. The method of claim 10 wherein said perfluroinatedphosphonic acid and perfluorinatedphosphinic acid are represented as follows:

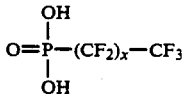

perfluorinated aliphatic phosphonic acid

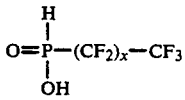

perfluorinated aliphatic phosphinic acid wherein x is an integer in a range from 2 to 10.

* * * * *

UNITED STATES PATENT AND TRADEMARK OFFICE

CERTIFICATE OF CORRECTION

PATENT NO. : 5,277,788

DATED : January 11, 1994

INVENTOR(S) : Gary A. Nitowski et al

It is certified that error appears in the above-identified patent and that said Letters Patent is hereby corrected as shown below:

Col. 20, line 13 Change "phosphinic" to --phosphonic--.
Claim 12

Signed and Sealed this

Twenty-sixth Day of July, 1994

Bruce Lehman

*Attest:*

BRUCE LEHMAN

*Attesting Officer*

*Commissioner of Patents and Trademarks*